US007367842B2

(12) United States Patent
Thörner et al.

(10) Patent No.: US 7,367,842 B2
(45) Date of Patent: May 6, 2008

(54) COAXIAL CONNECTING PLUG

(75) Inventors: Wolfgang B. Thörner, Hatzper Strasse 125, Essen (DE); Wolfgang Adamczak, Stuttgart (DE)

(73) Assignee: Wolfgang B. Thörner, Essen (DE)

( * ) Notice: Subject to any disclaimer, the term of this patent is extended or adjusted under 35 U.S.C. 154(b) by 0 days.

(21) Appl. No.: 10/587,231

(22) PCT Filed: Dec. 1, 2004

(86) PCT No.: PCT/EP2004/013600

§ 371 (c)(1),
(2), (4) Date: Dec. 27, 2006

(87) PCT Pub. No.: WO2005/071800

PCT Pub. Date: Aug. 4, 2005

(65) Prior Publication Data

US 2007/0155242 A1 Jul. 5, 2007

(30) Foreign Application Priority Data

Jan. 24, 2004 (DE) ..... 10 2004 003 651

(51) Int. Cl.
*H01R 13/648* (2006.01)

(52) U.S. Cl. ..... 439/609; 439/358

(58) Field of Classification Search ..... 439/609, 439/357–358, 352, 607, 610, 680, 677
See application file for complete search history.

(56) References Cited

U.S. PATENT DOCUMENTS

| | | | | |
|---|---|---|---|---|
| 3,616,673 | A * | 11/1971 | Miklos | 29/798 |
| 4,801,906 | A * | 1/1989 | Morris et al. | 335/17 |
| 5,573,417 | A * | 11/1996 | Hashizawa et al. | 439/310 |
| 6,056,578 | A * | 5/2000 | Lin | 439/358 |
| 6,095,841 | A | 8/2000 | Felps et al. | |
| 6,293,813 | B1 * | 9/2001 | Johnston et al. | 439/157 |
| 6,848,932 | B2 * | 2/2005 | Bowling et al. | 439/358 |
| 2005/0148230 | A1 * | 7/2005 | Flynn | 439/358 |

FOREIGN PATENT DOCUMENTS

| | | |
|---|---|---|
| DE | 675 024 C | 4/1939 |
| DE | 43 26 474 A1 | 2/1995 |
| DE | 298 09 365 U1 | 8/2000 |
| EP | 0 460 145 B1 | 12/1991 |
| WO | WO 86/03895 A | 7/1987 |

* cited by examiner

*Primary Examiner*—J. F. Duverne
(74) *Attorney, Agent, or Firm*—Collard & Roe, P.C.

(57) ABSTRACT

The invention relates to an electric connecting plug comprising a plug member provided with an internal contact and at least one external contact radially remote from the internal contact with respect to the longitudinal axis of the member. The plug member is received by a housing element which is applied by the internal part thereof on the contact side to the external part of the external contact in such a way that the external contact of the connecting plug is radially inwardly pressed against the external contact of a bush by the axial displacement of the plug member with respect to the housing element. In order to ease of handling the connecting plug, the invention is comprised of a plug member that is axially movably mounted in the housing element which is provided with a lever pivotally mounted thereon and effects the plug member in such a way that it is displaceable with respect to the plug element by actuating the lever.

11 Claims, 2 Drawing Sheets

COAXIAL CONNECTING PLUG

CROSS REFERENCE TO RELATED APPLICATIONS

Figure 1:
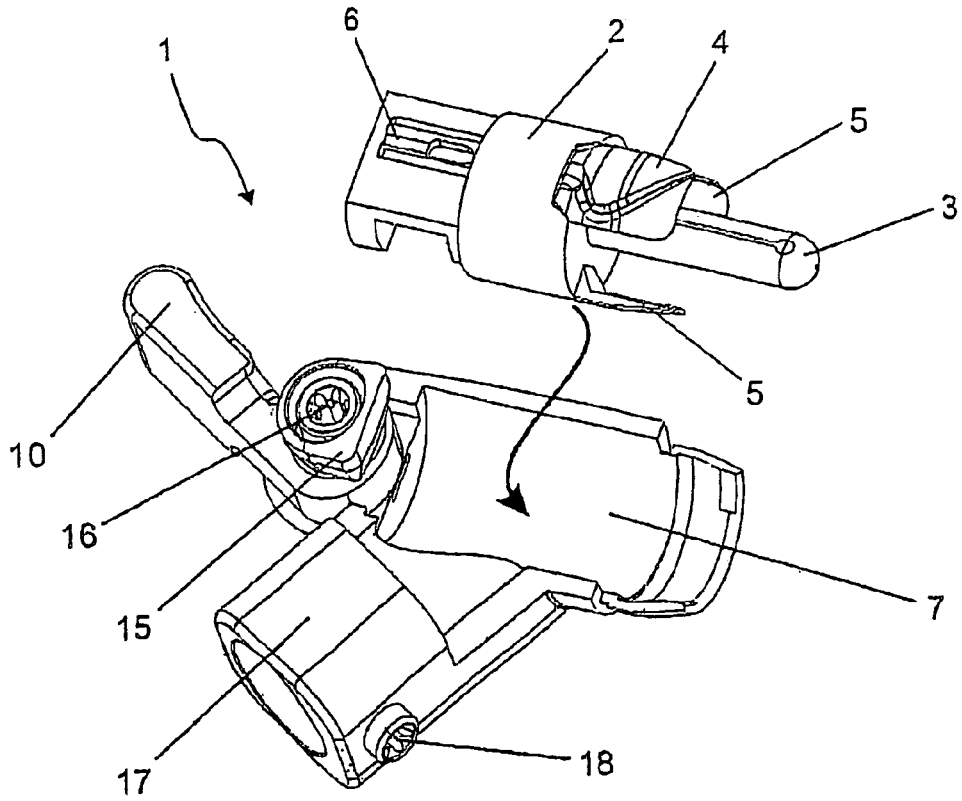

Applicants claim priority under 35 U.S.C. 119 of German Application No. 10 2004 003 651.9 filed Jan. 24, 2004. Applicants also claim priority under 35 U.S.C. 365 of PCT/EP2004/013600 filed Dec. 1, 2004. The international application under PCT article 21(2) was not published in English.

The invention relates to an electrical connecting plug having a plug body that has an internal contact pin and at least one external contact that is radially spaced apart from the internal contact pin, with reference to the longitudinal axis of the plug body, and having a housing element that accommodates the plug body, which element rests against the outside of the external contact with its inside, in the region of its contact-side, front opening, in such a manner that the external contact of the plug can be pressed radially inward against an external contact of a jack, by means of an axial movement of the plug body relative to the housing element.

Such connecting plugs are known under the designation "cinch plug" or also "RCA plug" and serve to produce a releasable cable connection between devices of entertainment electronics for the purpose of asymmetrical transmission of an audio signal or a video signal.

A connecting plug of the type stated initially is described, for example, in EP 0 460 145 B1. In the case of the previously known plug, a cover sleeve is provided, which surrounds the plug body. The cover sleeve lies against the outside of the external contact affixed to the plug body with its inside, in the region of its contact-side, front opening. The cover sleeve can be screwed onto the plug body in the axial direction, so that the external contact of the plug is pressed radially inward against the external contact of a jack that fits the plug when the cover sleeve is moved in an axial direction relative to the plug body when it is being screwed on. By means of pressing the external contact of the plug against the external contact of the jack, a non-positive-lock clamp connection is produced between plug and jack, so that the plug is held firmly on the jack, free of loosening. Therefore, a connection with a corresponding cinch jack that is both electrically and mechanically stable and secure can be produced with the previously known connecting plug.

A disadvantage of the previously known connecting plug consists in the fact that affixing the plug to a jack of a corresponding device of entertainment electronics is relatively complicated. Usually, in the case of such devices, the jacks built into the device housing are affixed on the back of the device. The user of the plug must therefore reach behind the device in order to insert the plug into a jack, and then use both hands to tighten the cover sleeve, in order to produce the clamp connection on the plug body. In this connection, one hand performs the rotational movement required for screwing the sleeve on, while the other hand holds the plug body in place so that it does not turn, also. Affixing the plug is particularly complicated if a plurality of jacks with plugs already plugged into them is present on the back of the device. This is the case, with particular frequency, for hi-fi amplifiers or receivers. Then it is often hardly possible to find sufficient room to clamp the plug tightly onto the jack with both hands. A further factor that increases the difficulty is that the user in question is usually standing at the front of the device when plugging the plug into the related jack, and must reach either over or to the side of the device when doing so, to screw the cover sleeve onto the plug body. Because of this arrangement, it is often difficult for the person standing in front of the device to recognize in what direction the cover sleeve must be turned to screw it on to the plug body. Frequently, the cover sleeve is then screwed in the wrong direction, so that it comes loose from the plug body unintentionally. For the reasons stated, connecting plugs of the type stated are often felt to be difficult to handle, even though a particularly firm and secure electrical plug connection can be produced with such plugs.

Proceeding from this, the present invention is based on the task of making available an electrical connecting plug in which the disadvantages and problems as outlined above are avoided as much as possible. In particular, it is supposed to be possible to insert the plug into a jack simply and quickly, using only one hand, and to fix it in place there.

This task is accomplished, proceeding from an electrical plug of the type stated initially, in that the plug body is mounted in the housing element so as to be axially displaceable, whereby a lever that acts on the plug body is affixed to the housing element so as to rotate, so that the plug body can be moved relative to the housing element by means of activating the lever.

In the case of the connecting plug according to the invention, the axial movement of the plug body within the housing element is brought about by means of activating the lever. Because the external contact of the plug can be pressed radially inward against the external contact of the corresponding jack in the case of axial movement of the plug body relative to the housing element, the plug according to the invention is fixed in place on the jack or released from it, respectively, by means of simple activation of the lever. In this connection, the use of the connecting plug can take place using only one hand, without any problems. The plug can be held with only one hand in order to plug it into a corresponding jack, for example. After insertion, the lever simply has to be activated in order to produce the non-positive-lock connection between plug and jack, and this can also take place using only one hand. To release the plug from the jack, the lever is activated again, and then the plug is grasped and pulled out of the jack. According to the invention, no screwing movement is required to fix the plug in place on the jack or to release it, so that handling of the plug is significantly simpler and less complicated than in the case of the plugs known from the state of the art.

In order to achieve a radial movement of the external contact of the plug, brought about by axial movement of the plug body relative to the housing element, it is practical if the external contact of the plug has a conically shaped end segment on its outside, whereby then the housing element can have a corresponding conical narrowing in the region of its front opening. In this manner, the axial movement of the plug body can be converted into a radial movement of the external contact, in particularly simple manner.

It is practical if, in the case of the connecting plug according to the invention, the housing element consists of a base body and a housing lid releasably connected with the base body, whereby the lever is mounted on the base body, so as to rotate. In the case of this embodiment, the plug body is easily accessible by means of removing the housing lid from the base body, or can actually be taken out of the housing element entirely. This guarantees that soldering cables onto the internal contact pin or to the external contact of the plug, for example, is possible without problems. In this connection, a particularly advantageous configuration of the connecting plug according to the invention results from the fact that a ring element is provided, which can be releasably affixed to the housing element, whereby the base body and the housing lid are held together by the ring body in the region of the front opening of the housing element. The ring body imparts particular stability to the housing element in the region of the front opening, and this is practical, since the press-down forces required to fix the plug in place on the jack must be applied by the housing element in this region. At the same time, the base body and the housing lid can be released from one another in particularly simple manner, by taking the ring body off.

A particularly advantageous further development of the connecting plug according to the invention results from the fact that the lever is configured as a cam lever, whose cam segment rests against the back of the plug body, facing away from the contact side. Conversion of the rotational movement of the lever into an axial movement of the plug body is determined by the shaping of the cam segment. The torque that acts on the cam lever can be converted to a great transverse force by way of the cam segment, which acts on the plug body in the axial direction. This results in the advantage that a strong press-down force is applied to fix the plug in place on the jack, while activation of the lever requires only a relatively slight expenditure of force. As a result, the plug according to the invention becomes particularly comfortable to handle. So that the connecting plug cannot come loose from the jack by itself, the cam lever should be shaped in such a manner, in its cam segment that rests against the plug body, that the cam lever engages in its clamping position in self-locking manner.

Particularly if the connecting plug according to the invention has a lever configured as a cam lever, in the manner outlined above, which engages on the back of the plug body, the housing element should have a cable guide segment that is angled away to the side, as compared with the longitudinal axis of the plug. Because of the lever disposed on the back of the plug body, a cable that is connected with the contacts of the plug body cannot be passed out of the housing element of the plug in this region. By way of the cable guide segment that is angled away to the side, the cable is guided out of the housing element to the side, accordingly. Because of the cable guide segment that is angled away to the side, it is advantageous that the housing element lies particularly well in the hand, and can be grasped in particularly comfortable manner to insert the plug into the jack or to pull the plug out of the jack. In this connection, the cable guide segment that is angled away to the side can be configured in the manner of a "pistol handle." It is practical if clamping devices are provided in the region of the cable guide segment, which serve to fix a cable that runs in the cable guide segment in place on the plug.

Another practical embodiment of the connecting plug results, according to the invention, in that the external contact of the plug is configured as an electrically conductive contact tongue in its contact region, whereby electrically conductive clamping tongues are provided in order to fix the plug in place on the jack, which can be pressed radially inward against the external contact of the jack, together with the contact tongue. Accordingly, the electrically conductive contact tongue is used as the external contact of the plug, so that the external contact—in contrast to conventional cinch plugs—does not completely surround the internal contact pin. In this way, the signal transmission properties of the plug are significantly improved. In order to guarantee secure fixation of the plug on the jack, electrically insulating clamping tongues are furthermore provided, which are pressed against the external contact of the jack by means of axial movement of the plug body relative to the housing element. The contact tongue and the clamping tongues work together to fix the plug according to the invention on the jack mechanically. In this way, an electrical connecting plug that is optimized both electrically and mechanically as compared with the state of the art is created. A particular advantage of the plug configured in the manner described above consists in the fact that the area of the contact tongue can be selected in such a manner that the impedance of the plug connection produced using the connecting plug can be adapted to the characteristic impedance of the cable being used. This is because the area of the contact tongue has a decisive influence on the impedance of the plug. It is advantageous that optimized impedance behavior can already be assured during the production of the plug, by means of a suitable determination of the area of the contact tongue.

A practical further development of the connecting plug according to the invention results, in turn, from the fact that the contact tongue has a line-shaped elevation on its inside, facing the external contact of the jack. In this connection, the electrical contact with the external contact of the jack is produced at a precisely defined point, by way of the line-shaped elevation. The contact area of the plug connection can be defined in precise and reproducible manner by means of the surface of the line-shaped elevation.

Figure 2:
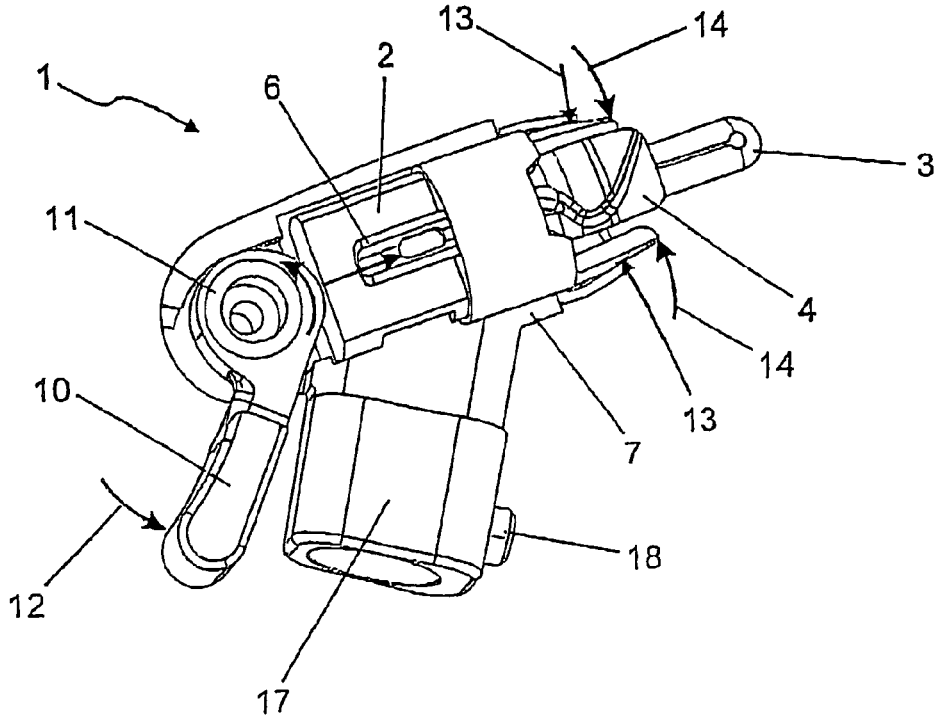
Figure 3:
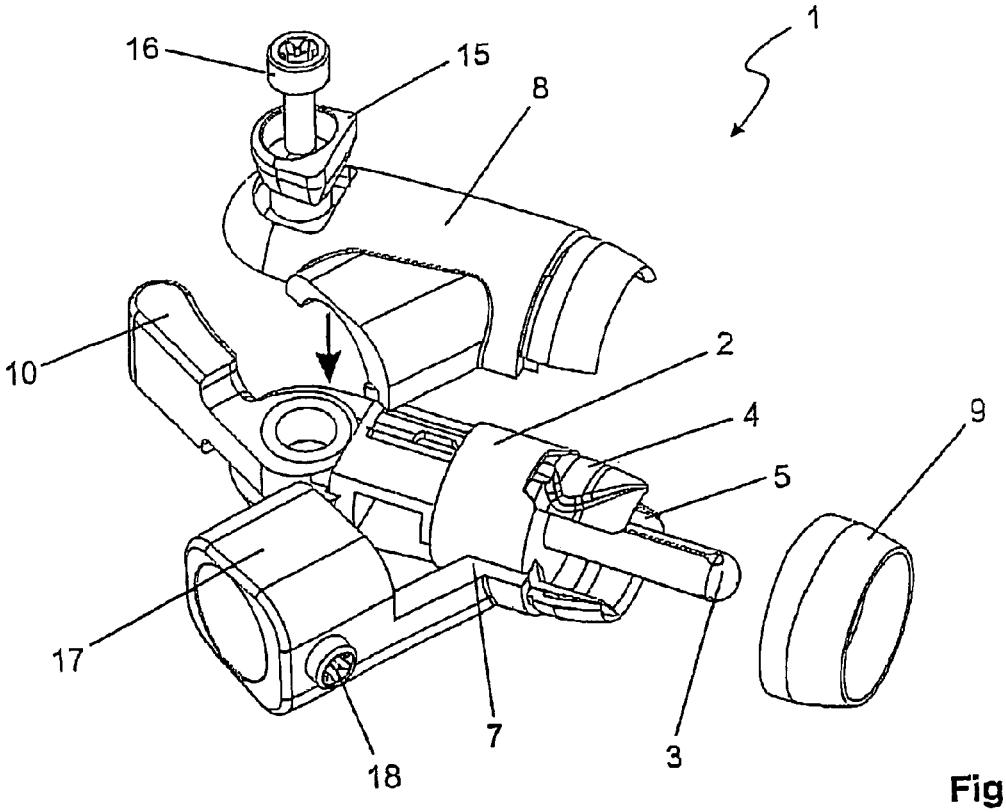
Figure 4:
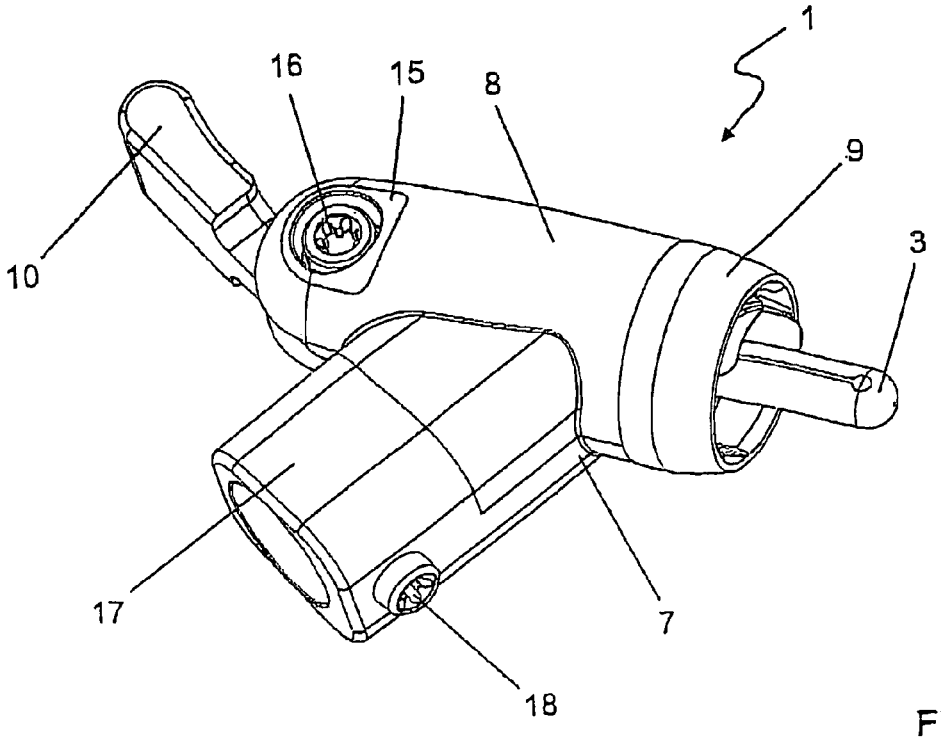

An exemplary embodiment of the invention will be explained in the following, using the figures. These show:

FIG. 1: connecting plug having a plug body that can be inserted into the housing element;

FIG. 2: illustration of the method of functioning of the plug;

FIG. 3: exploded view of the plug;

FIG. 4: view of the completely assembled plug.

In the figures, the electrical connecting plug according to the invention is designated as a whole with the reference number 1. The connecting plug 1 has a plug body 2, on which an internal contact pin 3 and an external contact 4, that is radially spaced apart from the former, with reference to the longitudinal axis of the plug body 2, are disposed. The external contact 4 of the plug 1 is configured as an electrically conductive contact tongue in its contact region, as can be seen using FIGS. 1, 2, and 3, whereby clamping tongues 5 consisting of electrically insulating material are provided, to fix the plug 1 in place on a corresponding jack. To connect the contact tongue 4 with a cable, a soldering tab 6 is provided. The plug body 2 is accommodated by a housing element that consists of a base body 7 and a housing lid 8 releasably connected with the base body 7. By means of a ring element 9 that can be seen in FIGS. 3 and 4, which element can be releasably affixed to the housing element, the base body 7 and the housing lid 8 are held together in the region of the front, contact-side opening of the housing element. In the case of the plug 1 shown in the figures, the ring element 9 can be set onto the housing element from the front, and engages in place there. As is evident from FIG. 2, the plug body 2 is mounted in the base body 7 of the housing element so as to be axially displaceable, whereby a lever 10 is mounted on the base body 7, so as to rotate, which lever acts on the plug body 2, so that the plug body 2 can be moved relative to the housing element of the plug 1 by means of activating the lever 10. In the exemplary embodiment shown in the figures, the lever 10 is configured as a cam lever, the cam segment 11 of which rests against the back of the plug body 2, facing away from the contact side. By means of activating the lever 10 in the direction indicated by the arrow 12, the plug body 2 is moved axially forward, i.e. towards the contact side of the plug 1. Both the contact tongue 4 and the clamping tongues 5 have conically shaped end segments on their outsides, whereby the housing element rests against the outside of the contact tongue and the clamping tongues in the region of its inside, in the region of its front opening, specifically in the contact region indicated by the arrows 13. The housing element has a conical narrowing in this region, so that the contact tongue 4 and the clamping tongues 5 can be pressed radially inward against an external contact of a jack, not shown in greater detail, by means of the axial movement of the plug body 2 relative to the housing element. The radial movement of the contact tongue 4 and the clamping tongues 5 is illustrated in FIG. 2 with the arrows 14. The axis of rotation of the lever 10 is formed by a screw 16 inserted into a cuff 15, by means of which the housing lid 8 is attached to the base body 7 at the same time. In the case of the connecting plug 1 shown in the figures, the housing element has a cable guide segment 17 that is angled away to the side relative to the longitudinal axis of the plug 1, whereby a clamping screw 18 is provided on the cable guide segment 17 to fix a cable that runs in the cable guide segment 17 and is not shown in detail in place on the plug.

The invention claimed is:

1. Electrical connecting plug having a plug body (2) that has an internal contact pin (3) and at least one external contact that is radially spaced apart from the internal contact pin (3), with reference to the longitudinal axis of the plug body (2), and having a housing element that accommodates the plug body (2), which said housing element rests against the outside of the external contact with its inside, in the region of its contact-side, front opening, in such a manner that the external contact of the plug is pressed radially inward against an external contact of a jack, by means of an axial movement of the plug body (2) relative to the housing element, wherein the plug body (2) is mounted in the housing element so as to be axially displaceable, whereby a lever (10) that acts on the plug body (2) is affixed on the housing element so as to rotate, so that the plug body (2) is moved relative to the housing element by means of activating the lever (10).

2. Electrical connecting plug according to claim 1, wherein the external contact of the plug (1) has a conically shaped end segment on its outside.

3. Electrical connecting plug according to claim 1, wherein the housing element has a conical narrowing in the region of its front opening.

4. Electrical connecting plug according to claim 1, wherein the housing element consists of a base body (7) and a housing lid (8) releasably connected with the base body (7), whereby the lever (10) is mounted on the base body (7) so as to rotate.

5. Electrical connecting plug according to claim 4, comprising a ring element (9) that can be releasably affixed to the housing element, whereby the base body (7) and the housing lid (8) are held together by the ring body (9) in the region of the front opening of the housing element.

6. Electrical connecting plug according to claim 1, wherein the lever (10) is configured as a cam lever whose cam segment (11) rests against the back of the plug body (2), facing away from the contact side.

7. Electrical connecting plug according to claim 6, wherein the cam lever (10) is shaped in such a manner, in its cam segment (11) that rests against the plug body (2), that the cam lever (10) engages into its clamping position in self-locking manner.

8. Electrical connecting plug according to claim 1, wherein the housing element has a cable guide segment (17) that is angled away to the side relative to the longitudinal axis of the plug (1).

9. Electrical connecting plug according to claim 8, comprising a clamping device (18) disposed on the region of the cable guide segment (17) for fixing a cable that runs in the cable guide segment (17) in place on the plug.

10. Electrical connecting plug according to claim 1, wherein the external contact of the plug (1) is configured as an electrically conductive contact tongue (4) in its contact region, whereby electrically insulating clamping tongues (5) are provided to fix the plug (1) in place on the jack, which can be pressed radially inward against the external contact of the jack together with the contact tongue (4).

11. Electrical connecting plug according to claim 10, wherein the contact tongue (4) has a line-shaped elevation on its inside, facing the external contact of the jack.

* * * * *